United States Patent [19]

Rocha et al.

[11] 4,380,231

[45] Apr. 19, 1983

[54] FOOT EXERCISER

[76] Inventors: Frank Rocha, c/o George Spector, 3615 Woolworth Bldg., 233 Broadway; George Spector, 3615 Woolworth Bldg., 233 Broadway, both of New York, N.Y. 10007

[21] Appl. No.: 229,764

[22] Filed: Jan. 29, 1981

[51] Int. Cl.[3] ..... A63B 23/04
[52] U.S. Cl. ..... 128/57; 272/96
[58] Field of Search ..... 272/96, 127; 128/60, 128/25 B, 57, 58

[56] References Cited

U.S. PATENT DOCUMENTS

| | | | |
|---|---|---|---|
| 2,037,495 | 4/1936 | Brogan | 272/96 |
| 2,121,250 | 6/1938 | Koschwitz | 128/25 B |
| 2,230,890 | 2/1941 | McClenathen | 272/96 |

FOREIGN PATENT DOCUMENTS

| | | | |
|---|---|---|---|
| 125274 | 9/1947 | Australia | 128/57 |

*Primary Examiner*—Richard J. Johnson

[57] ABSTRACT

A device for exercising a person's foot; the device including a stand for placement upon a floor, the stand supporting a freely rotatable roller across which the person rolls his foot, and the device, in one design including roller eccentricity adjustability.

1 Claim, 5 Drawing Figures

FOOT EXERCISER

This invention relates generally to exercising apparatus. More specifically it relates to a device for exercising feet.

It is well known that exercising the body is beneficial for good health, and exercising of the feet is essential for prevention and also cure of muscular aches in the feet. More feet problems occur as a person gets older and tends to become more sedentary and does less walking.

It is an object of the present invention to provide a foot exerciser which allows a person to exercise the feet while sitting in a chair, the exerciser massaging the feet so as to improve the muscle tone and blood circulation thereof so as to keep the feet in good health or improve them from any existing foot problems.

Another object is to provide a foot exerciser which can be used while a person is either simply relaxing, or else is sitting and reading, or doing any other chore such as knitting, whittling wood, or working at a desk.

Figure 2:
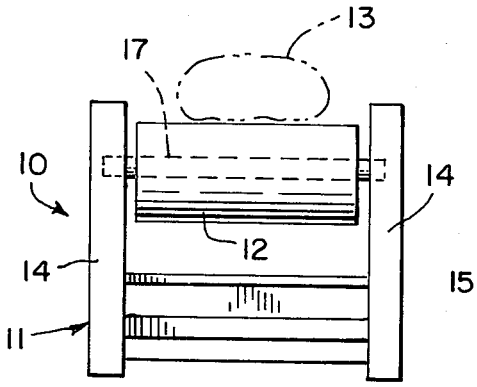
FIG. 2 is an end view of one design of the invention in which the roller is mounted on a pin journalled in bearing holes of the frame.
Figure 3:
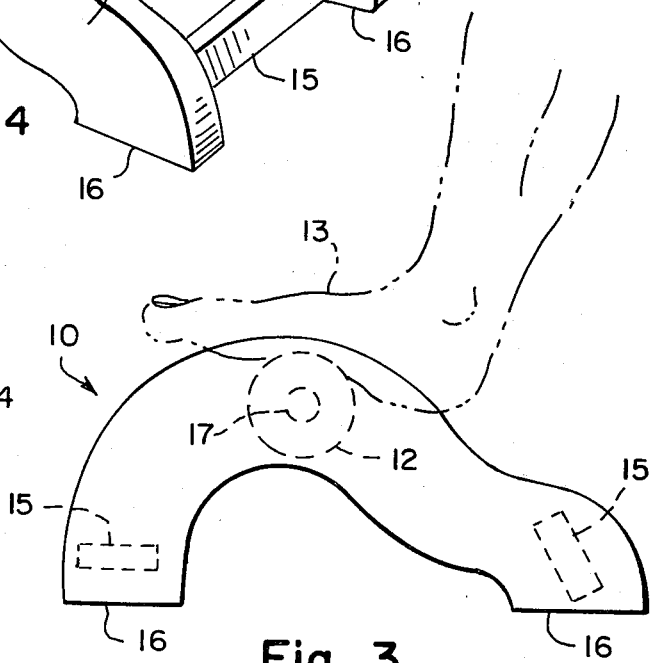
FIG. 3 is a side view thereof, shown in use by a foot placed thereupon.

Referring now to the drawing in greater detail and more particularly to FIGS. 2 and 3 thereof, at this time, the reference numeral 10 represents a foot exerciser according to the present invention, wherein there is a stand 11 that freely supports a roller 12 across which a foot 13 of a person may be rolled so as to exercise the same. The stand is comprised of two inverted, generally U-shaped legs 14 made of wood and which are held together by two wooden cross bars 15, so that a foot 16 at each opposite end of each leg may rest upon a floor. A spindle 17 is supported horizontally between the legs, and the roller is fitted on the spindle. The roller may be made of solid wood. Alternately it may additionally be covered by any material that may be beneficial for massaging purposes, if preferred.

In operative use, a person seated on either a chair or rocking chair, simply rolls each foot across the roller as shown in FIG. 3 so to massage the foot. Sufficient space between the roller and the cross bars allows placing the foot under the roller in case an upper side thereof is wished to be massaged, while the other foot holds down the exerciser by bearing against one of the crossbars.

The device may be made wide enough so that both feet may roll across the roller at a same time, as preferred by a manufacturer.

Figure 1:
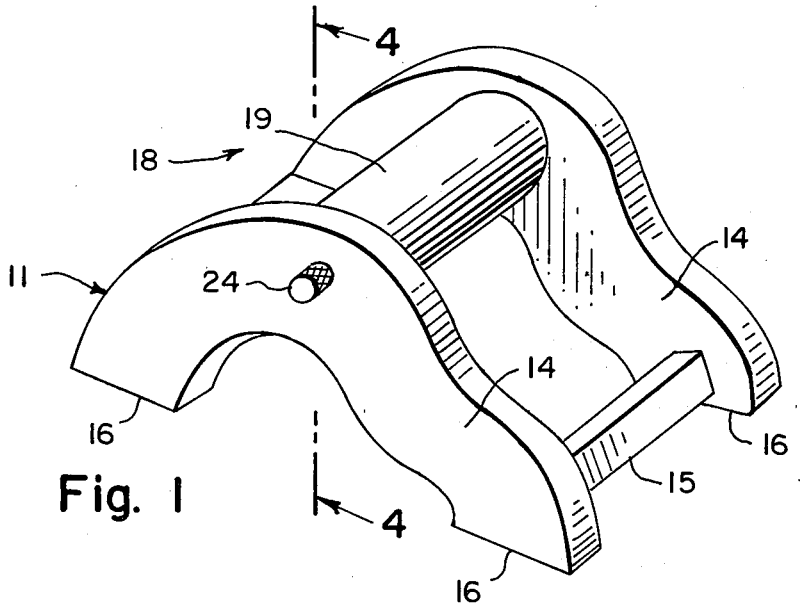
FIG. 1 is a perspective view of the invention.
Figure 4:
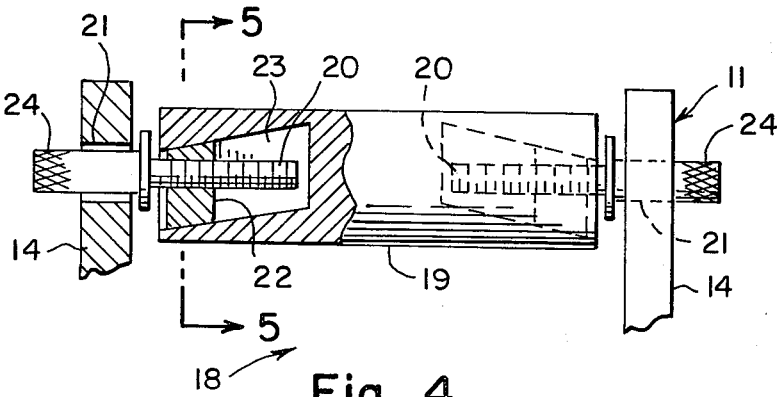
FIG. 4 is a side view, partly in cross-section, of another design, in which the roller is eccentrically adjustable for an additional massaging of also the ankle joint as well.
Figure 5:
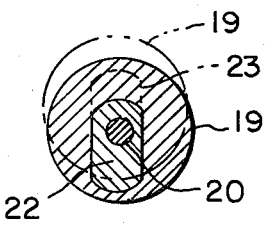
FIG. 5 is a cross sectional view on line 5—5 of FIG. 4, and showing in phantom lines, the roller in an eccentric position.

The foot exerciser 18, shown in FIGS. 1,4 and 5 utilizes a same stand 11, however it includes a roller 19 which may be eccentrically adjusted while it rolls for a variation in the massaging action. The roller is adjustably supported at each end on a screw 20 supported in a hole 21 of the stand leg, the screw engaging a generally rectangular block 22 slidable in a generally rectangular hole 23 inside the roller, each hole 23 being angularly inclined respective to the roller longitudinal axis, and both holes being angled toward a common same point, as shown in FIG. 4. An outer end 24 of each screw protrudes outwardly from the leg 14 and is knurlled so as to be easily rotated between the fingers in order to slide the block on the screw and thus move the roller eccenrically respective to an axis extending through the two screws. When the blocks are at the positions shown in FIG. 4, the roller axis is a same as the screw axis, however as the blocks are moved toward the screw ends, the roller then rotates eccentrically respective to the screw axis, for producing the massaging variation.

What is claimed as new, is:

1. A foot exerciser, comprising in combination, a stand and a roller supported rotatably free on said stand, and means whereby said roller is eccentrically adjustable respective to a rotational axis thereof wherein said stand is comprised of a pair of inverted generally U-shaped legs each of which has a foot at each end for standing on a floor, and a pair of cross bars between said legs; said roller being supported between said legs, wherein a pair of axially aligned screws supported rotatably in said legs are each screw engaged on a rectangular block in an angularly inclined hole in said roller.

* * * * *